US005690757A

United States Patent [19]

Ljungars

[11] Patent Number: 5,690,757

[45] Date of Patent: Nov. 25, 1997

[54] METHOD FOR CONTINUOUS RECRYSTALLIZATION ANNEALING OF A STEEL STRIP

[75] Inventor: Sten Ljungars, Torshälla, Sweden

[73] Assignee: Avesta Sheffield, Stockholm, Sweden

[21] Appl. No.: 302,870

[22] PCT Filed: Mar. 17, 1992

[86] PCT No.: PCT/SE92/00162

§ 371 Date: Sep. 14, 1994

§ 102(e) Date: Sep. 14, 1994

[87] PCT Pub. No.: WO93/19000

PCT Pub. Date: Sep. 30, 1993

[30] Foreign Application Priority Data

Sep. 21, 1990 [SE] Sweden ..... 9003018

[51] Int. Cl.[6] ..... C21D 8/02

[52] U.S. Cl. ..... 148/603; 148/579

[58] Field of Search ..... 148/579, 602, 148/653, 603

[56] References Cited

U.S. PATENT DOCUMENTS 3,388,011 6/1968 Zacksy et al. ..... 148/653

FOREIGN PATENT DOCUMENTS 1 260 798 2/1968 Germany .

602573 4/1978 U.S.S.R. ..... 148/653

OTHER PUBLICATIONS

Derwent's Abstract, accession number 74–16917v/09, SU–384903, publ week 7409, Orbit Search Service, File WPAT Aug. 1978.

*Primary Examiner*—John Sheehan

*Attorney, Agent, or Firm*—Nixon & Vanderhye

[57] ABSTRACT

Method for the continuous manufacture of steel strip in which steel strip is fed into an annealing furnace at a certain feed-in rate and drawn out of the furnace at a rate higher than the feed-in rate while subjecting the steel strip to a pulling force in the annealing furnace at a temperature above the recrystallization temperature of the steel in the region of 1000° to 1250° C. This results in the introduction of a permanent stretch of the steel strip corresponding to the difference between the feed-out and feed-in rates as well as a reduction in the cross-section of the strip corresponding to the elongation and a reduction of the strip thickness and strip width.

6 Claims, 1 Drawing Sheet

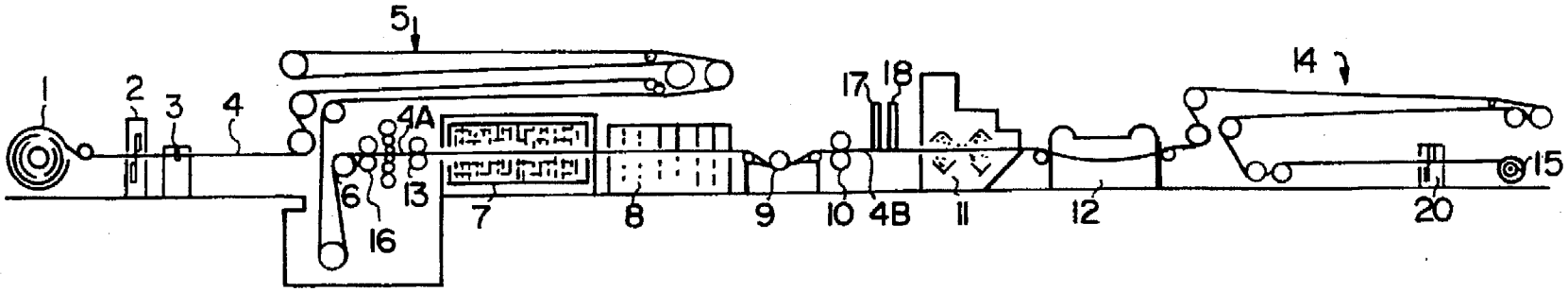
1
2
3
4
5
4A
6
13
16
7
8
9
10
4B
17
18
11
12
14
20
15

METHOD FOR CONTINUOUS RECRYSTALLIZATION ANNEALING OF A STEEL STRIP

TECHNICAL FIELD

The invention concerns a method relating to the manufacturing of steel strips, comprising continuous treatment of the steel strip in an annealing furnace at a temperature between 1000° C. and 1250° C.

BACKGROUND OF THE INVENTION

The rolling of steel strips usually is carried out for several reasons. A primary objective is to afford the steel strip a desired thickness. The rolling usually is performed as hot rolling down to a thickness in the dimension range 1–12 mm, preferably 1–mm, whereupon continued reduction of the thickness to desired final thickness is performed through cold rolling. In connection with the cold rolling, usually one or more annealing operations are included for the recrystallization of the steel structure.

In connection with this technique, it is difficult to achieve the desired final thickness in a simple and practical way.

Another problem concerns the breadth of the strip. The end product shall have a certain desired strip breadth, which must at least be reached. In order to meet with this requirement it is conventional to use, as starting material for the cold rolling operation, hot rolled strips having a breadth which substantially exceeds the desired final breadth. This implies that larger amounts of edge scrap are formed at the manufacturing than what is required for the more or less unavoidable conditioning of the edges of the strip. The formation of this scrap material from the edge portions, which is due to poor adaptation of the breadth of the raw strips to the breadth required by the customer and also due to the fact that there are no possibilities to adjust the breadth of the strips in the cold roll mills, represents very large losses.

BRIEF DESCRIPTION OF THE INVENTION

The purpose of the invention is to solve the above mentioned problems. This can be achieved by the method of the present invention wherein steel strip is fed continuously into an annealing furnace at a certain feed-in rate and drawn out of the furnace at a rate higher than the feed-in rate while subjecting the steel strip to a pulling force in the annealing furnace at a temperature above the recrystallization temperature of the steel in the region of 1000° to 1250° C. This results in the introduction of a permanent stretch of the steel strip corresponding to the difference between the feed-out and feed-in rates as well as a reduction in the cross-section of the strip corresponding to the elongation and a reduction of the strip thickness and strip width. The method of the invention has been developed particularly for austenitic stainless steels but can be used also for other steel grades, stainless as well as other alloyed steels, and also for carbon steels. The principles of the invention per se also can be utilized for the manufacturing of metal strips, which do not consist of steel, particularly metals which are subjected to cold hardening during cold working, as for example copper and copper alloys. Further features and aspects of the invention will be apparent from the following description of a preferred embodiment.

BRIEF DESCRIPTION OF THE DRAWINGS

A preferred embodiment of the invention, various aspects of the invention, and performed experiments will be described in the following with reference to the accompanying drawing, which illustrates a production plant, in which facilities for performing the method of the invention are integrated.

DETAILED DESCRIPTION OF THE INVENTION

In the drawing, a roll of hot rolled steel strip is generally designated 1. As an alternative the starting material—the steel strip 1—may consist of a cold rolled, annealed strip. A cutter is designated 2, and a welding apparatus for welding together strip sections is designated 3. The steel strip, consisting of sections which have been welded together, and which shall be treated according to the invention, is designated 4. The plant shown in the drawing also includes the following members, namely a strip store or accumulator 5, a first braking mill 6, a cold rolling mill 16, a second braking mill 13, an annealing furnace 7, an air-cooling chamber for forced air cooling 8, and aggregate 9 for water cooling of the strip, a drawing mill 10, a wheel abrator 11, a pickling bath 12, a store or accumulator of finished strips 14, and a winding-up drum containing the final product 15. Measuring devices for measuring the breadth and thickness of the strip have been designated 17 and 18, respectively.

In the integrated process which comprises the method according to the invention, strips are unwound from the reel 1, are cut in their ends by the cutter 2, are spliced in the welding apparatus 3, and are directed into the strip accumulator 5, which forms a buffer of steel strip 4, so that the continued process can be performed completely continuously. The hot rolled strip 4 has, when it enters the accumulator 5 a thickness of between 1 and 12 mm, preferably a thickness between 1 and 6 mm.

From the strip accumulator 5, the steel strip 4 is fed through the first braking mill 6 and thereafter into the cold rolling mill 16. According to a preferred embodiment of the method according to the invention, the strip 4 is subjected to a reduction of the thickness in the cold rolling mill 16 essentially without any change of the breadth of the strip. How large this thickness reduction shall be according to a preferred embodiment will be explained in the following. According to one aspect of the invention the cold rolling, however, in certain cases can be eliminated.

After having passed the second braking mill 13, the preferably cold rolled strip 4A thereafter is drawn through an annealing furnace 7, further through the cooling chamber 8 in which the annealed strip 4B is subjected to forced air-cooling, and thereafter through the water cooling aggregate 9 by means of the drawing mill 10. In the annealing furnace 7 the cold rolled strip 4A is heated from about 20° C. to a temperature exceeding the recrystallization temperature of the steel. A suitable temperature for most steel grades is between 1000° C. and 1250° C. Preferably the steel strip should be heated to a temperature between 1080° C. and 1200° C. By choosing a temperature within the temperature region between 1000° C. and 1250° C., and preferably within the region between 1080° C. and 1200° C., the holding time in the annealing furnace 7 can be made so short that the requirement upon sufficient holding time will not be a limiting factor for the production in the plant.

The tensile properties of metallic materials are strongly dependent on temperature. Hooke's law does not apply at high temperatures, at least not more than for very small tensions. The material will creep already at moderate tensions, which may be lower than those which correspond to the yield point at room temperature for the same material.

These conditions are utilized in the method according to the invention. By subjecting the strip 4A to a tensile stress exceeding the creep limit of the material, that is to say within the creeping region of the material, in the annealing furnace 7 at a temperature exceeding the recrystallization temperature of the material, there is achieved a permanent elongation of the strip in the longitudinal direction of the strip, corresponding to the difference between on one hand the rate with which the annealed and thereafter cold strip 4B is fed into the drawing mill 10 and on the other hand the rate with which the strip 4 is fed into the braking mill 13. This permanent stretch or elongation completely takes place within that region of the strip which is heated to a high temperature, that is to say in the annealing furnace 7. The elongation of the strip in other words can be described as the elongation of an immovable strip a certain, limited distance, e.g. to a stop, at a high temperature.

Subsequent to the drawing mill 10 the stretched and cold strip is passed through the wheel abrator 11 and the pickling bath 12 and is fed into the strip accumulator 14. Finally, the strip is cut in the cutter 20 and is wound up on the winding-up roller 15.

Through the stretching in the annealing furnace 7 and the permanent elongation of the strip achieved through this stretch, the cross section of the strip is reduced to an extent corresponding to the elongation. The reduction of the cross section takes place in the form of the reduction of the thickness of the strip and in the reduction of the breadth of the strip.

At some point after the annealing furnace, suitably before the drawing mill 10, the breadth and the thickness of the elongated and cold strip 4B are measured by means of the measuring devices 17, 18. According to a preferred embodiment of the invention, the rates of the drawing mill 10 and of the second braking mill 13 are controlled and adjusted such that the rate difference will cause such a large elongation that the breadth of the strip is reduced to a certain strip breadth. The thickness of this strip having the desired thickness is measured by means of the measuring device 18. Thereafter the cold rolling mill 16 is adjusted such that it will reduce the thickness of the strip 4 so much that the combined thickness reduction in the cold rolling mill 16 because of the rolling in the cold rolling mill 16 and the thickness reduction in the annealing furnace 7 due to the permanent elongation of the material in this furnace will give the strip 4B a thickness which corresponds to the desired final thickness for the desired strip breadth. By this preferred embodiment it is in other words possible to achieve as well a desired strip thickness as a desired strip breadth which involves a number of significant advantages.

It should be understood that the adjustment of the cold rolling mill 16 may have an impact on the relative ratios between thickness reduction and breadth reduction in the annealing furnace 7, and that the adjustment of the difference of rate of the drawing mill 10 and the braking mill 13 as well as the roll pressure in the cold rolling mill 16 may require repeated measurements and adjustments, that is to say that a certain running-in period may be necessary before stable conditions have been achieved. These matters, however, can be solved through conventional regulation technology. Also empirically obtained knowledge can be utilized for this adjustment work.

In Table 1 there is shown results from ten tests, which concerned continuous elongation of steel strips in an annealing furnace. All the strips which were tested were of an austenitic stainless steel, grade Avesta 18-9 (SIS 2333) having the nominal composition 18 chromium, 9 nickel, 0.04 carbon, 0.5 manganese, 0.7 silicon, balance iron and unavoidable impurities. The steel strip first had been hot rolled to a thickness of about 2.75 mm and a breadth of about 1050 mm. The strips were heated in the annealing furnace to a temperature of 1170° C., except in one case, when the temperature was 1130° C. Two different elongations were applied at the experiments, namely 8% and 14%. When the elongation was 8%, the feeding-in rate to the furnace 7 was 5 m/min, while the feeding-in rate at the elongation 14% was varied between 5 and 15 m/min. At the last test, when the elongation was 14% and the feeding-in rate was 15 m/min, the annealing temperature was also lowered from 1170° C. to 1130° C. The breadth and thickness values were measured before and after the elongation and also necessary strip pulling forces were registered.

From the results the following conclusions can be drawn, which are believed to apply at least for austenitic stainless steels, namely that the breadth reduction is almost constant at constant elongation, even if the feeding rate is varied;

that the thickness reduction is almost constant at constant elongation, even if the feeding rate is varied; and that the tension in the strip calculated on a reduced area is increased with increased elongation values.

TABLE 1

| Test No | Stretch (elongation) % | Temp. °C. | Feeding in rate of the strip m/min | Feeding-in and -out breadth mm | Reduction of breadth % | Feeding-in and -out thickness mm | Thickness reduction % | Pulling force in furnace KN | Strip tension in the feeding-in portion N/mm² | Strip tension calculated on reduced area N/mm² |
|---|---|---|---|---|---|---|---|---|---|---|
| 1 | 8 | 1170 | 5 | 1047/1028 | 1.81 | 2.77/2.61 | 5.78 | 49 | 16.9 | 18.3 |
| 2 | 14 | 1170 | 5 | 1049/1005 | 4.19 | 2.77/2.54 | 8.30 | 55 | 18.9 | 21.5 |
| 3 | 14 | 1170 | 7 | 1050/1005 | 4.29 | 2.78/2.54 | 8.63 | 58 | 19.9 | 22.7 |
| 4 | 14 | 1170 | 9 | 1051/1005 | 4.38 | 2.77/2.55 | 7.94 | 62 | 21.3 | 24.2 |
| 5 | 14 | 1170 | 11 | 1050,5/1005 | 4.33 | 2.75/2.54 | 7.64 | 62 | 21.3 | 24.3 |
| 6 | 14 | 1170 | 13 | 1050,5/1006 | 4.24 | 2.78/2.54 | 8.63 | 62 | 21.3 | 24.3 |
| 7 | 14 | 1170 | 15 | 1051,5/1007 | 4.23 | 2.78/2.54 | 8.63 | 62 | 21.3 | 24.2 |
| 8 | 14 | 1130 | 15 | 1051/1007 | 4.19 | 2.76/2.55 | 7.61 | 60 | 20.6 | 23.4 |

I claim:

1. Method for the continuous manufacture of steel strip, comprising:

(a) subjecting steel strip to at least one cold rolling step to produce cold rolled steel strip and cause a first strip thickness reduction;

(b) feeding said cold rolled steel strip into an annealing furnace at a certain feed-in rate and drawing out of the furnace at a feed-out rate which is higher than said feed-in rate;

(c) subjecting said cold rolled steel strip to a pulling tension in said annealing furnace at a temperature between 1000° and 1250° C. to give a permanent elongation of at least 8% to said steel strip corresponding to the difference between said feed-out and feed-in rates, and also to give a reduction in cross-section of the strip corresponding to said elongation, including a reduction in strip width and a second strip thickness reduction.

2. Method according to claim 1, wherein said strip is subjected to hot rolling prior to said at least one cold rolling step to cause an initial strip thickness reduction prior to annealing and stretching in said furnace.

3. Method according to claim 1, wherein said cold rolled steel strip is subjected to said pulling tension at a temperature between 1080° and 1200° C.

4. Method according to claim 1, wherein said strip is continuously stretched in said annealing furnace so as to reduce the width of said strip to a certain final width at the same time as said second strip thickness reduction is achieved, said strip being worked in said cold rolling operation to an extent depending on said second thickness reduction, so that said cold rolling and elongation produces a strip thickness after annealing corresponding to a desired final strip thickness.

5. Method according to claim 1, wherein said elongation is 8%.

6. Method according to claim 1, wherein said elongation is 14%.

* * * * *